US006409290B1

(12) United States Patent
Lin

(10) Patent No.: US 6,409,290 B1
(45) Date of Patent: Jun. 25, 2002

(54) DRAWER FASTENING DEVICE

(75) Inventor: Hui-Liang Lin, Chiayi Hsien (TW)

(73) Assignee: San Jye Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/781,670

(22) Filed: Feb. 12, 2001

(51) Int. Cl.[7] ..... E05B 65/46

(52) U.S. Cl. ..... 312/219; 312/217; 312/221; 70/83

(58) Field of Search ..... 70/81, 83, 84; 312/221, 216, 217, 218, 219, 220, 233, 227

(56) References Cited

U.S. PATENT DOCUMENTS 2,719,770 A * 10/1955 Roberts ..... 312/221 X
4,963,640 A * 6/1990 Pratzer ..... 312/221
5,074,627 A * 12/1991 Broeders ..... 312/221
5,257,860 A * 11/1993 Slivon ..... 312/219 X
5,503,440 A * 4/1996 Peccoux ..... 312/218 X
5,605,388 A * 2/1997 Laakso ..... 312/218

* cited by examiner

*Primary Examiner*—Peter M. Cuomo
*Assistant Examiner*—Michael J. Fisher
(74) *Attorney, Agent, or Firm*—Alan Kamrath; Rider, Bennett, Egan & Arundel, LLP

(57) ABSTRACT

A drawer fastening device is disposed on a drawer. The drawer fastening device has a lock device, a connection plate, a slide plate, a plurality of hooking plates, a plurality of pivot pins, and a positioning frame. The positioning frame has a plurality of slide slots and a plurality of enlarged holes. The slide plate has an upper end groove and a plurality of through holes. Each hooking plate has an upper distal hook and a lower blocking bar. Each pivot pin fastens the positioning frame, the hooking plate and the slide plate together. The lock device has a positioning seat, a driven plate connected to the positioning seat, and a mount connected to the driven plate. The connection plate is fastened in the mount pivotally and the connection plate is connected to the driven plate. The slide plate is connected to the connection plate.

3 Claims, 6 Drawing Sheets

DRAWER FASTENING DEVICE

BACKGROUND OF THE INVENTION

The present invention relates to a drawer fastening device. More particularly, the present invention relates to a drawer fastening device which can lock a drawer even if the drawer is not closed.

Referring to FIG. 1, a conventional drawer fastening device is disposed on a drawer 1. The conventional drawer fastening device has a lock device 2 and a core device 21 engaging with the lock device 2. The drawer 1 has a blocking bar 11. A slide plate 22 has a stop plate 222 and an oblong slot 221 to receive the core device 21. When the drawer 1 is closed and locked, the blocking bar 11 blocks the stop plate 222. However, the drawer 1 cannot be locked if the drawer 1 is not closed.

SUMMARY OF THE INVENTION

An object of the present invention is to provide a drawer fastening device which can lock a drawer even if the drawer is not closed.

Accordingly, a drawer fastening device is disposed on a drawer having a plurality of insertion grooves. The drawer fastening device comprises a lock device disposed on a top portion of the drawer, a connection plate, a slide plate, a plurality of hooking plates, a plurality of pivot pins, and a positioning frame disposed on the drawer. The positioning frame has a plurality of slide slots and a plurality of enlarged holes. Each slide slot communicates with one of the enlarged holes. The slide plate has an upper end groove and a plurality of through holes. Each hooking plate has an upper distal hook and a lower blocking bar. Each pivot pin fastens the positioning frame, the corresponding hooking plate and the slide plate together through one of the enlarged holes of the positioning frame and one of the through holes of the slide plate. The lock device has a positioning seat, a driven plate connected to the positioning seat, and a mount connected to the driven plate. The positioning seat has a hooking portion. The driven plate has a distal notch. The connection plate is fastened in the mount pivotally and the connection plate is connected to the driven plate. The slide plate is connected to the connection plate.

DETAILED DESCRIPTION OF THE INVENTION

Figure 1:
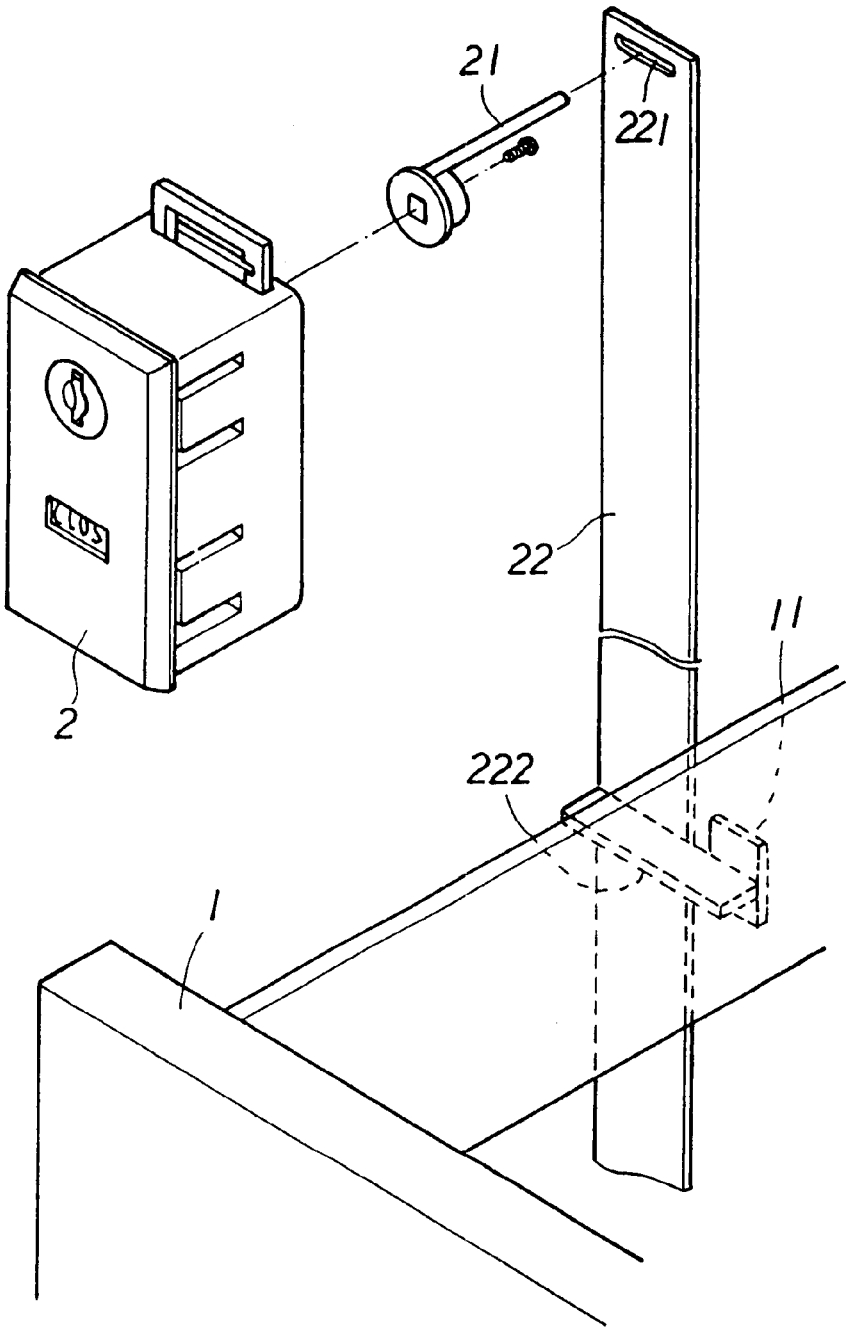
F I G. 1 PRIOR ART
FIG. 1 is a perspective exploded view of a conventional drawer fastening device of the prior art.
Figure 2:
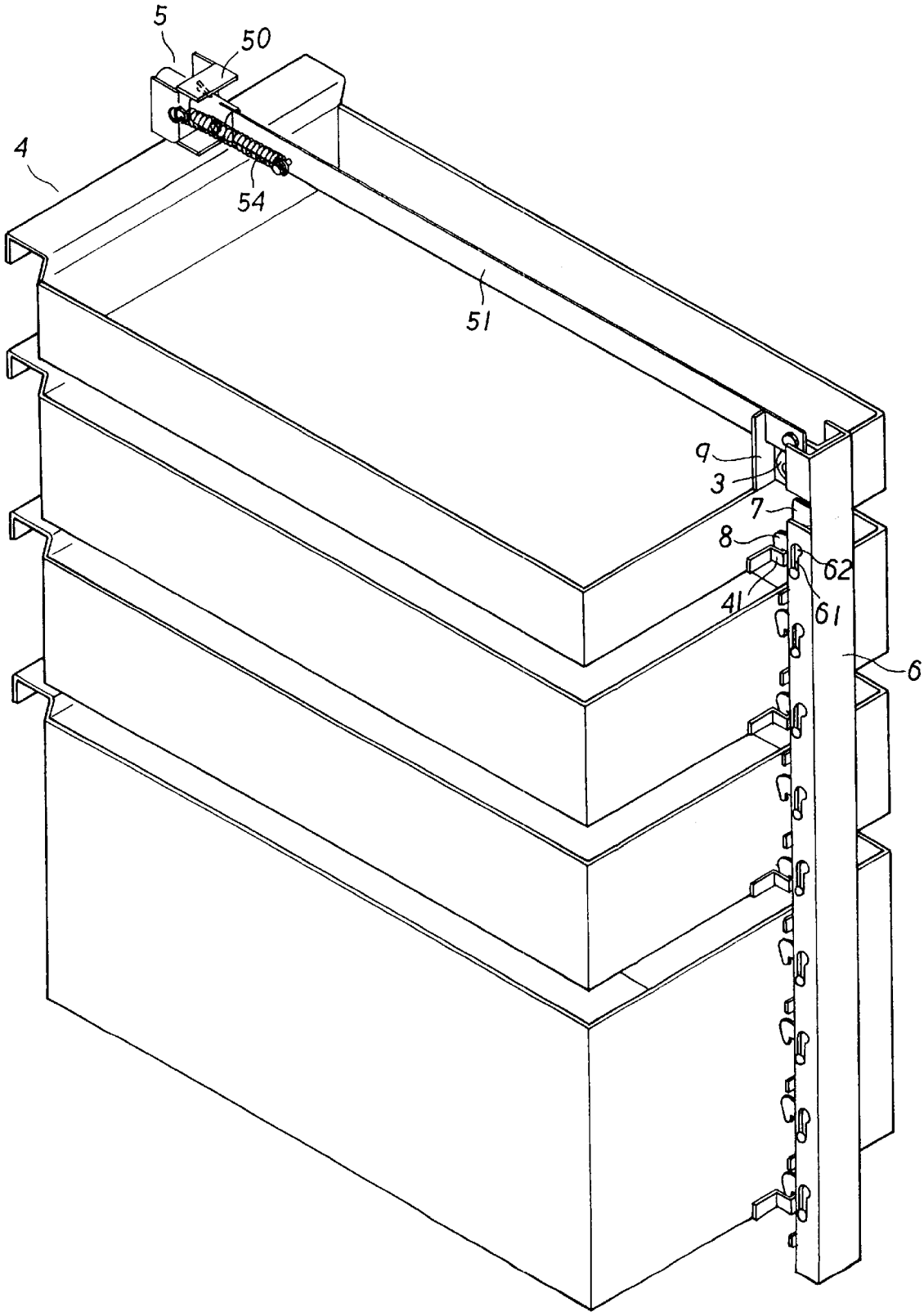
FIG. 2 is a perspective assembly view of a drawer fastening device of a preferred embodiment disposed on a drawer.
Figure 3:
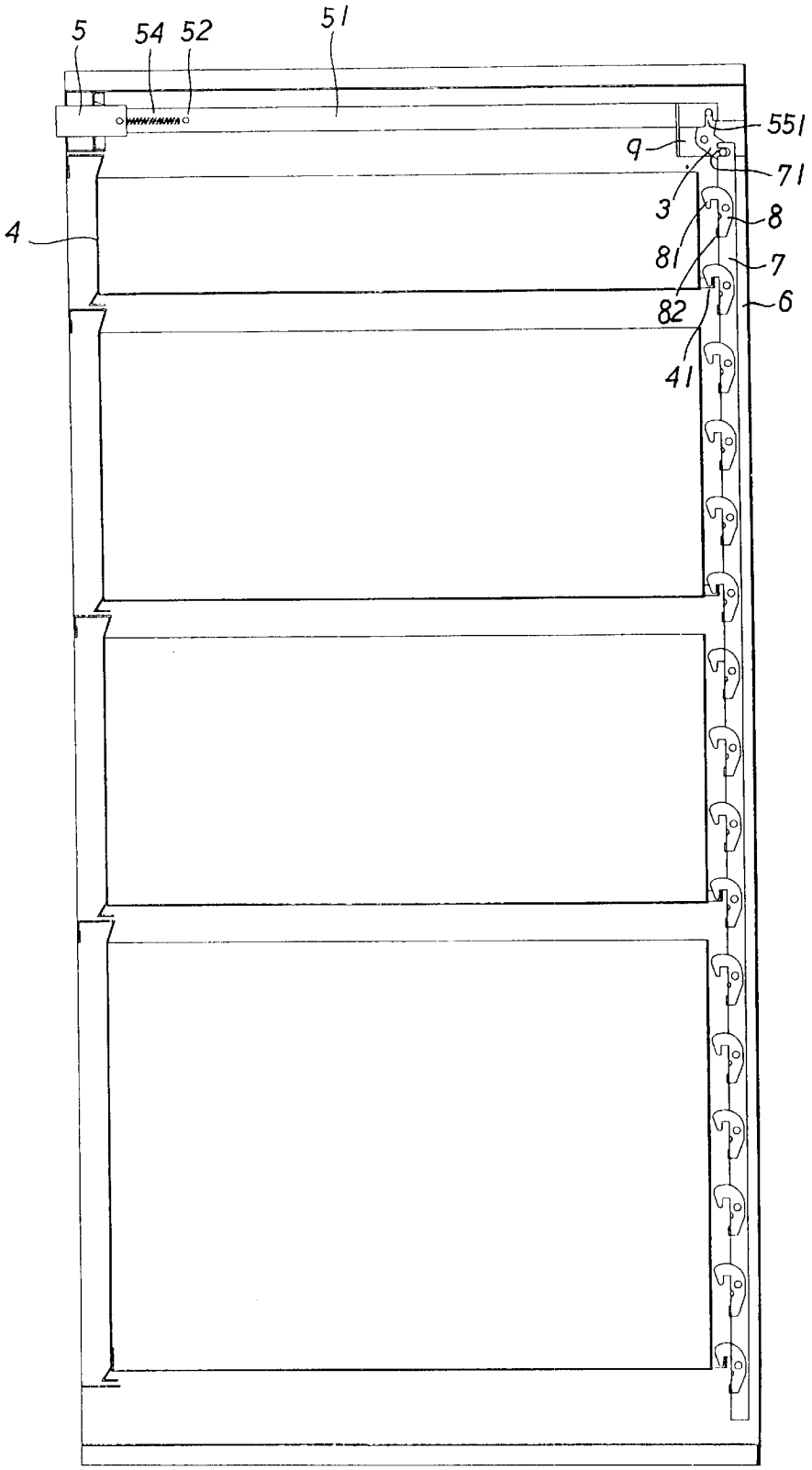
FIG. 3 is an elevational view of FIG. 2.
Figure 4:
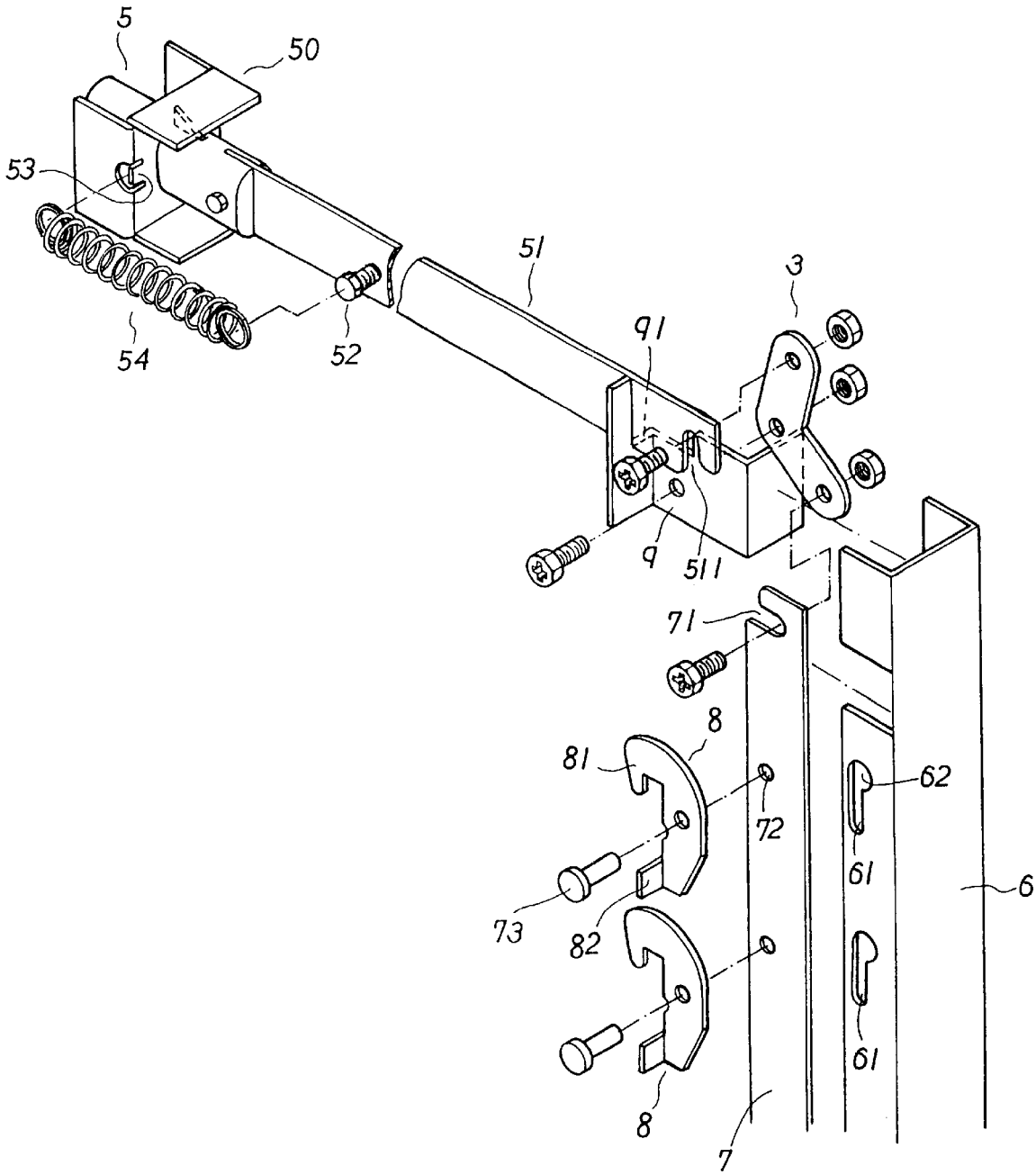
FIG. 4 is a perspective exploded view of a drawer fastening device of a preferred embodiment in accordance with the present invention.
Figure 5:
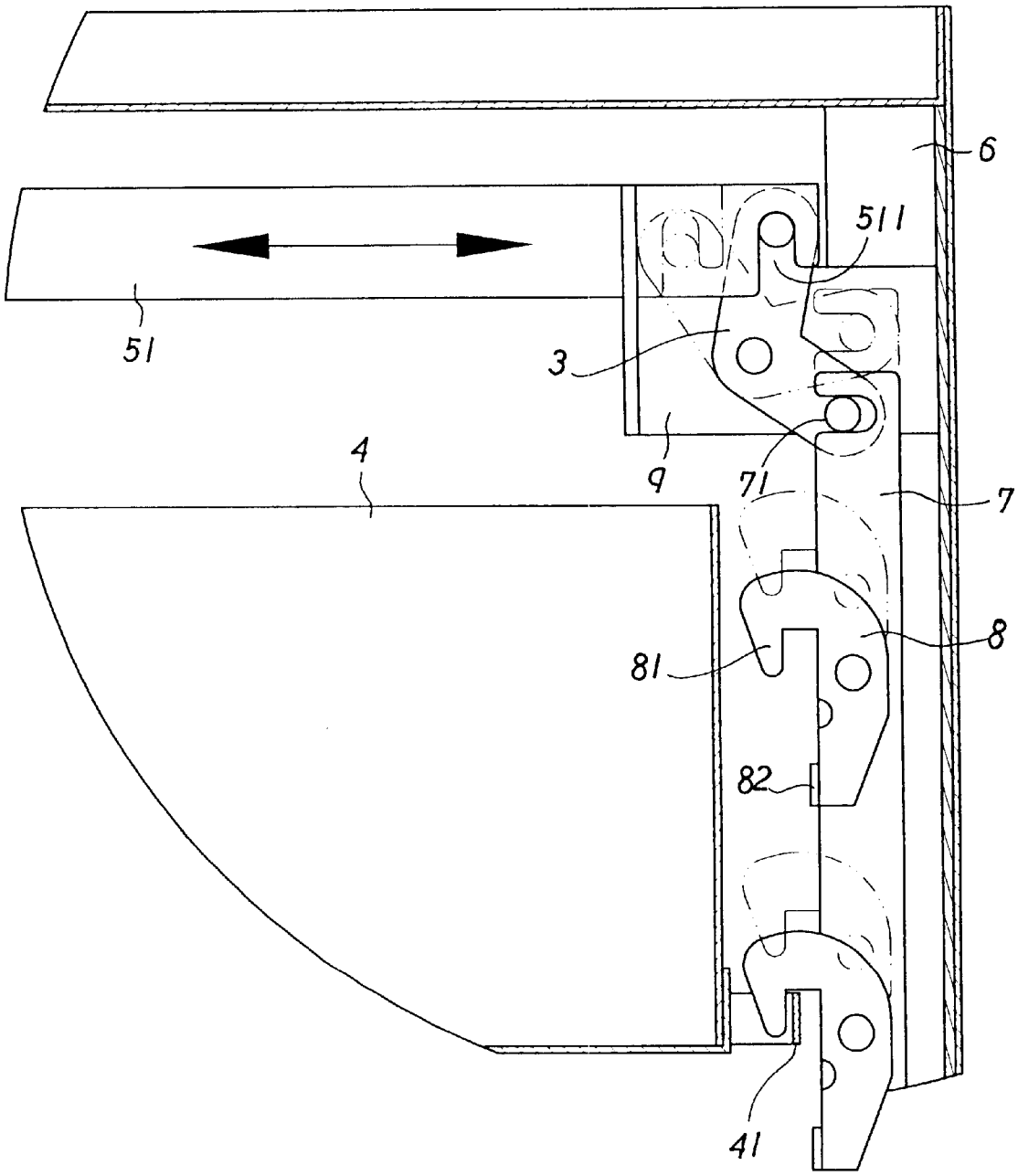
FIG. 5 is a schematic view illustrating an operation of a drawer fastening device of a preferred embodiment in accordance with the present invention.
Figure 6:
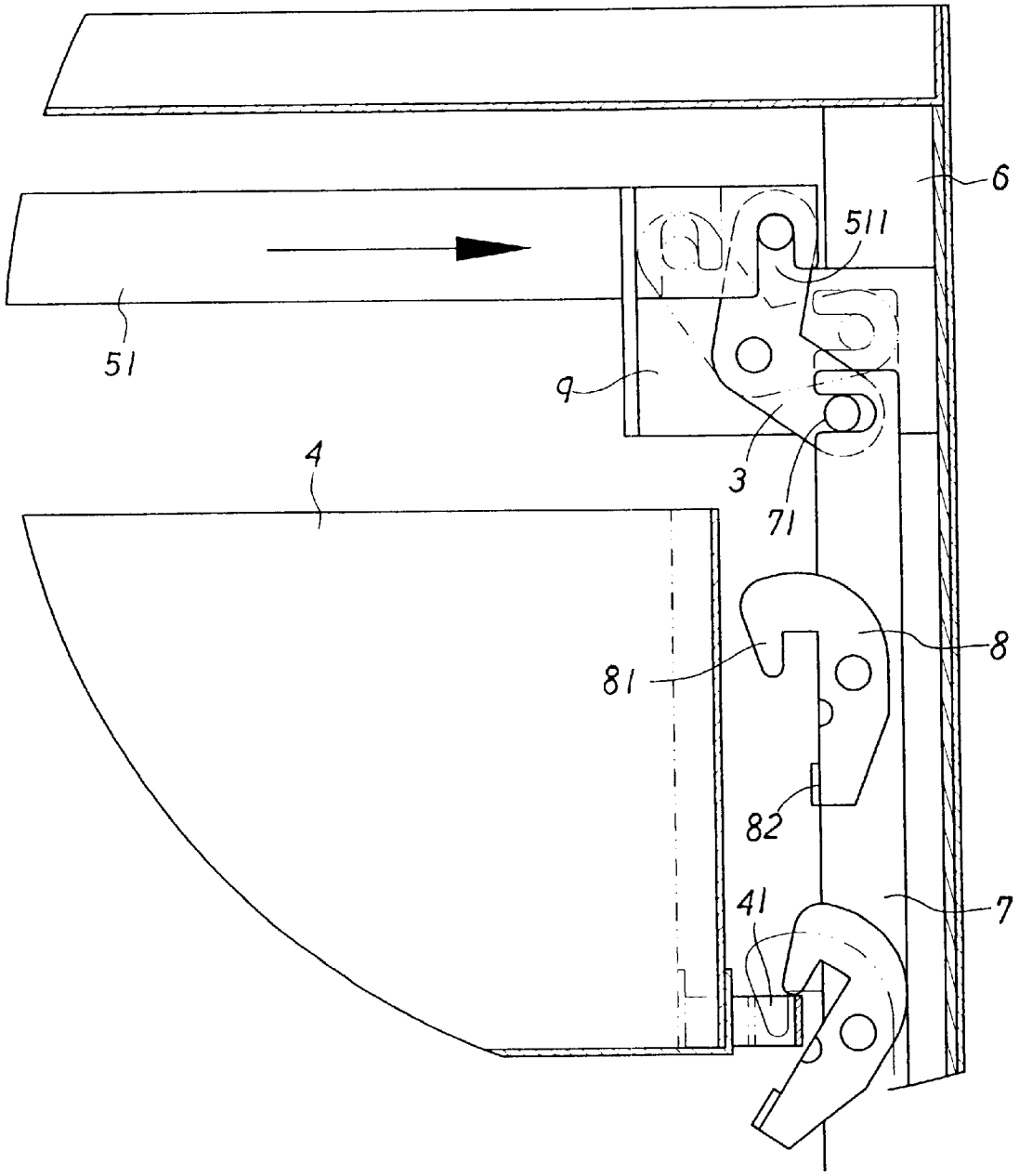
FIG. 6 is a schematic view illustrating a locking operation of a drawer fastening device of a preferred embodiment while a drawer is not closed.

Referring to FIGS. 2 to 6, a drawer fastening device is disposed on a drawer 4 which has a plurality of insertion grooves 41. The drawer fastening device comprises a lock device 5 disposed on a top portion of the drawer 4, a connection plate 3, a slide plate 7, a plurality of hooking plates 8, a plurality of pivot pins 73, and a positioning frame 6 disposed on the drawer 4.

The positioning frame 6 has a plurality of slide slots 61 and a plurality of enlarged holes 62. Each slide slot 61 communicates with one of the enlarged holes 62.

The slide plate 7 has an upper end groove 71 and a plurality of through holes 72.

Each hooking plate 8 has an upper distal hook 81 and a lower blocking bar 82.

Each pivot pin 73 fastens the positioning frame 6, the corresponding hooking plate 8 and the slide plate 7 together through one of the enlarged holes 62 of the positioning frame 6 and one of the through holes 72 of the slide plate 7.

The lock device 5 has a positioning seat 50, a driven plate 51 connected to the positioning seat 50, and a mount 9 connected to the driven plate 51.

The mount 9 has a hollow interior 91.

A post 52 is disposed on the driven plate 51.

A spring 54 is connected to the post 52.

The positioning seat 50 has a hooking portion 53 engaging with an end of the spring 54.

The driven plate 51 has a distal notch 511.

The connection plate 3 is fastened in the mount 9 pivotally and the connection plate 3 is connected to the driven plate 51.

The slide plate 7 is connected to the connection plate 3.

When the lock device 5 is operated, the driven plate 51 will move forward and rearward.

Referring to FIG. 5 again, each upper distal hook 81 is inserted in the corresponding insertion grooves 41 of the drawer 4.

Referring to FIG. 6 again, each upper distal hook 81 is inserted in the corresponding insertion grooves 41 of the drawer 4 while the drawer 4 is not closed.

The present invention is not limited to the above embodiment but various modification thereof may be made. Furthermore, various changes in form and detail may be made without departing from the scope of the present invention.

I claim:

1. A drawer fastening device disposed on a drawer having a plurality of insertion grooves, and the drawer fastening device comprising:

a lock device disposed on a top portion of the drawer, a connection plate, a slide plate, a plurality of hooking plates, a plurality of pivot pins, and a positioning frame disposed on the drawer, the positioning frame having a plurality of slide slots and a plurality of enlarged holes, each said slide slot communicating with one of the enlarged holes, the slide plate having an upper end groove and a plurality of through holes, each said hooking plate having an upper distal hook and a lower blocking bar, each said pivot pin fastening the positioning frame, the corresponding hooking plate and the slide plate together through one of the enlarged holes of the positioning frame and one of the through holes of the slide plate, the lock device having a positioning seat, a driven plate connected to the positioning seat, and a mount connected to the driven plate, the positioning seat having a hooking portion, the driven plate having a distal notch, the connection plate fastened in the mount pivotally and the connection plate connected to the driven plate, and the slide plate connected to the connection plate.

2. The drawer fastening device as claimed in claim 1, wherein a post is disposed on the driven plate.

3. The drawer fastening device as claimed in claim 2, wherein a spring is connected to the post and the hooking portion of the positioning seat.

* * * * *